US009190031B1

(12) United States Patent
Gilmore

(10) Patent No.: US 9,190,031 B1
(45) Date of Patent: Nov. 17, 2015

(54) PIANO STRING TUNING USING INDUCTIVE CURRENT PUMPS AND ASSOCIATED METHOD OF USE

(71) Applicant: Don Gilmore Devices, LLC, Kansas City, MO (US)

(72) Inventor: Donald Allen Gilmore, Kansas City, MO (US)

(73) Assignee: Don Gilmore Devices, LLC, Kansas City, MO (US)

( * ) Notice: Subject to any disclaimer, the term of this patent is extended or adjusted under 35 U.S.C. 154(b) by 4 days.

(21) Appl. No.: 14/268,465

(22) Filed: May 2, 2014

(51) Int. Cl.
*G10H 1/32* (2006.01)
*G10C 3/10* (2006.01)

(52) U.S. Cl.
CPC ..... *G10C 3/10* (2013.01)

(58) Field of Classification Search
CPC ..... G10C 3/10
USPC ..... 84/454, 455, 458, 200, 312 R, 644
See application file for complete search history.

(56) References Cited

U.S. PATENT DOCUMENTS

| | | | |
|---|---|---|---|
| 4,044,239 | A | 8/1977 | Shimauchi et al. |
| 4,958,550 | A | 9/1990 | Kugimoto |
| 5,038,657 | A | 8/1991 | Busley |
| 5,065,660 | A | 11/1991 | de Buda |
| 5,323,680 | A | 6/1994 | Miller et al. |
| 5,756,913 | A | 5/1998 | Gilmore |
| 6,278,047 | B1 | 8/2001 | Cumberland |
| 6,437,226 | B2 | 8/2002 | Oudshoorn et al. |
| 6,559,369 | B1 | 5/2003 | Gilmore |
| 6,784,353 | B1 | 8/2004 | Davis |
| 7,446,251 | B2 | 11/2008 | Lee |
| 7,678,982 | B2 | 3/2010 | Adams |
| 7,786,373 | B2 | 8/2010 | Adams |
| 7,935,876 | B1 | 5/2011 | West |
| 8,440,897 | B1 | 5/2013 | Baxter |
| 2006/0042452 | A1 | 3/2006 | Brown |

*Primary Examiner* — Jeffrey Donels
(74) *Attorney, Agent, or Firm* — Thompson Coburn LLP

(57) ABSTRACT

A present disclosure relates to a method and apparatus for tuning piano strings by heating the piano strings. The apparatus includes split magnetic cores that encircle the piano strings. The magnetic cores comprise wiring wrapped around the outside of the magnetic cores to induce an alternating current in the piano strings through mutual inductance. The generated alternating current in the piano strings allows each piano string to be heated and thereby tuned.

21 Claims, 6 Drawing Sheets

PIANO STRING TUNING USING INDUCTIVE CURRENT PUMPS AND ASSOCIATED METHOD OF USE

BACKGROUND OF THE INVENTION

1. Field of the Invention

This invention relates generally to self-tuning pianos and, more particularly, to a piano string tuning apparatus that tunes piano strings by inducing an alternating current in the piano string through mutual inductance.

2. Related Art

U.S. Pat. No. 6,559,369 to Gilmore ("Gilmore") entitled "Apparatus and Method for Self-Tuning a Piano," filed on Jan. 14, 2002, which is now U.S. Pat. No. 6,559,369, the entire disclosure of which is hereby incorporated by reference in its entirety, describes a self-tuning piano that tunes piano strings by passing electrical current through the metal piano strings, thereby causing the piano strings to increase in temperature. Such an increase in temperature causes the piano strings to thermally expand and elongate, thereby lowering the tension and pitch of the piano string. By varying an electrical current in the piano string, a supervisory circuit can accurately control the pitch of the piano string until the piano string is in tune.

While some notes of a piano comprise only one piano string, some notes of the piano are grouped into sets of two or three piano strings, tuned in unison. All piano strings pass through an agraffe. An agraffe is a brass stud with one, two, or three holes, depending on the number of piano strings comprising a particular note. Because brass is a conductive material, as many as three piano strings are electrically connected through the agraffe. Because multiple piano strings are electrically connected through one agraffe, controlling the current for an individual piano string is impossible. As a solution, Gilmore proposed agraffes constructed using an electrically-insulating material so that electrical current may be applied to each piano string individually.

The electrically-insulated agraffe solution invented by Gilmore required insulating agraffes to be installed in a new piano at the factory, or, for existing pianos, the solution invented by Gilmore required complete replacement of all electrically-conductive agraffes within the piano with electrically-insulating agraffes. Complete agraffe replacement is a time-consuming, tedious, and costly operation because the piano must be restrung after replacement of the agraffes. Another disadvantage of the electrically-insulated agraffe is that the insulating material may affect the tone and timbre of the piano adversely, or cause the agraffe to be too weak to handle the high tensile forces of the piano strings.

SUMMARY OF THE INVENTION

It is in view of the above problems that the present invention was developed. The present invention comprises a plurality of current pumps made from a high-permeability material that surround each piano string in the piano. The current pumps may comprise two split halves, so that each current pump may be installed around the piano string without the need to remove the piano string from the piano. Each half of the current pump is wound with insulated electrical wire. The wire winding each half of the current pump may meet at a center tap terminal. Each wire winding includes three terminals, which may be connected to an external circuit: a center tap terminal made accessible where the first half of the wire winding meets the second half of the wire winding, a beginning terminal at the beginning of the winding, and an end terminal at the end of the wire winding.

The center tap terminal may permanently connect to the positive terminal of a DC power supply, the beginning terminal may connect to a first transistor, and the end terminal may connect to a second transistor. Each current pump may further comprise a controller, e.g., microcontroller, processor, and so forth, configured to supply the two transistors with varying logical "high" or "low" electronic voltages to the gate of each transistor. Alternately connecting the beginning terminal and the end terminal of the windings to electrical ground using the two transistors generates an alternating magnetic flux in the current pump. In another embodiment, the center tap terminal may connect to electrical ground while alternately connecting the beginning terminal and the end terminal to the positive terminal of the DC power supply. The controller, e.g., microcontroller, processor, and so forth, provides logical voltages to the transistors at a high, alternating frequency.

The chip for the controller, e.g., microcontroller, processor, and so forth, may be further configured to interrupt the high-frequency signal according to a pulse-width modulation scheme in order to control temperature and pitch of the piano string.

In one embodiment, an apparatus for automatic tuning of a piano string includes a core at least having two side members, wherein the two side members are separated by the piano string when positioned for the automatic tuning; a wire winding wound around the two side members of the core, wherein the wire winding includes a beginning terminal at a first end of the wire winding, an end terminal at a second end of the wire winding, and a center tap terminal at a midsection of the wire winding connected to a positive terminal of a DC power supply; and an electrical switching mechanism configured to alternatingly electrically connect either the beginning or end terminal to ground to thereby induce an alternating magnetic flux in the core, thereby inducing an alternating electrical current in a piano string for the purpose of changing its temperature and pitch.

In another embodiment, an apparatus for automatic tuning of a piano string includes a core at least having two side members, wherein the two side members are separated by the piano string when positioned for the automatic tuning; a wire winding wound around the two side members of the core, wherein the wire winding includes a beginning terminal at a first end of the wire winding, an end terminal at a second end of the wire winding, and a center tap terminal at a midsection of the wire winding connected to a positive terminal or ground; and an electrical switching mechanism configured to alternatingly electrically connect either the beginning or end terminal to a DC power supply to thereby induce an alternating magnetic flux in the core, thereby inducing an alternating electrical current in a piano string for the purpose of changing its temperature and pitch.

In another embodiment, a method for inducing an alternating electrical current in a piano string to tune the piano string comprises: installing a current pump around a piano string by placing two members of the current pump on opposite sides of the piano string, wherein a wire winding is wound around the two members of the current pump; applying a voltage to a center tap terminal of the wire winding; connecting a first terminal on a first end of the wire winding to ground while disconnecting a second terminal on a second end of the wire winding from ground; and subsequently connecting the second terminal to ground while disconnecting the first terminal from ground.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings:

FIG. 1(*b*) illustrates internal components of the current pump according to an exemplary embodiment;

Figure 1B:
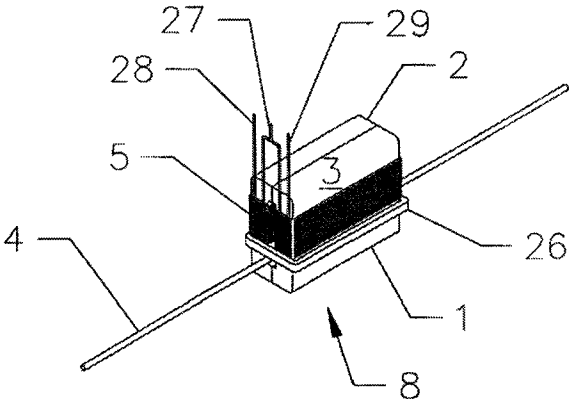
FIG. 1(*a*) illustrates a current pump according to an exemplary embodiment.

Reference characters in the written specification indicate corresponding items shown throughout the drawing figures.

DETAILED DESCRIPTION OF THE PREFERRED EMBODIMENT

Figure 1A:
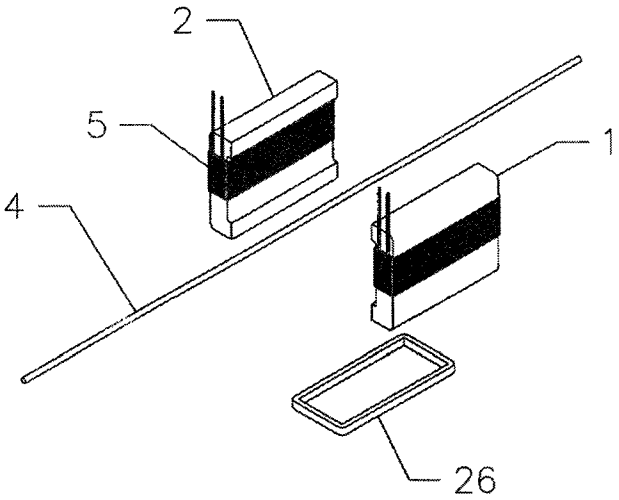

Referring to the accompanying drawings in which like reference numbers indicate like elements, FIGS. 1(*a*) and 1(*b*) illustrate a current pump 8 comprising two split core halves 1 and 2 comprising a high-permeability core 3. As a result of the split core halves 1 and 2, the core 3 has a hollowed out hole allowing a piano string 4 to extend through the core 3. In another embodiment, the core 3 may be a "U" shape, rather than completely surround the piano string 4. In either the "U" shape or the complete string surrounding core, the core 3 has at least two side members that are separated by the piano string 4 when positioned for tuning. The core 3 may comprise ferrite, as is commonly used for shielding electronic wire, but the core 3 may comprise any material with a high magnetic permeability, such as Permalloy, iron, or nickel. Each split core half 1 and 2 includes an electrical wire 5 wound a plurality of times around the core 3. The number of windings in the electrical wire 5 may vary depending on which piano string 4 in the piano the current pump 8 surrounds. For example, a lower bass note string may require more windings, while a higher note string may require fewer windings. In some pianos, twelve to fifteen, e.g., fourteen, turns of the windings per split core half 1 and 2 is sufficient to induce an electric current within the piano string 4 for most notes. The electrical wire 5 may comprise lacquer-coated magnet wire, as is commonly used to wind transformers, motors, and other industrial coils.

In operation, the two wire-wound split core halves 1, 2 of the current pump 8 may touch or nearly touch each other to encircle the piano string 4. The split core halves 1, 2 may be held together around the piano string 4 with a band 26, which can be an elastic band or a twist-tie. In another embodiment, the split core halves 1, 2 may mechanically connect using clamps, snaps, Velcro, or any other mechanical connection (not shown). The end of the first half core winding 1 is connected to the beginning of the second half core winding 2 to form a junction. This junction also forms a center tap terminal 27. The current pump 8 further includes a beginning terminal 28 and an end terminal 29 accessible by extending a wire from the beginning of the one half-core winding 1 winding and end of the second half core winding 2.

Figure 2:
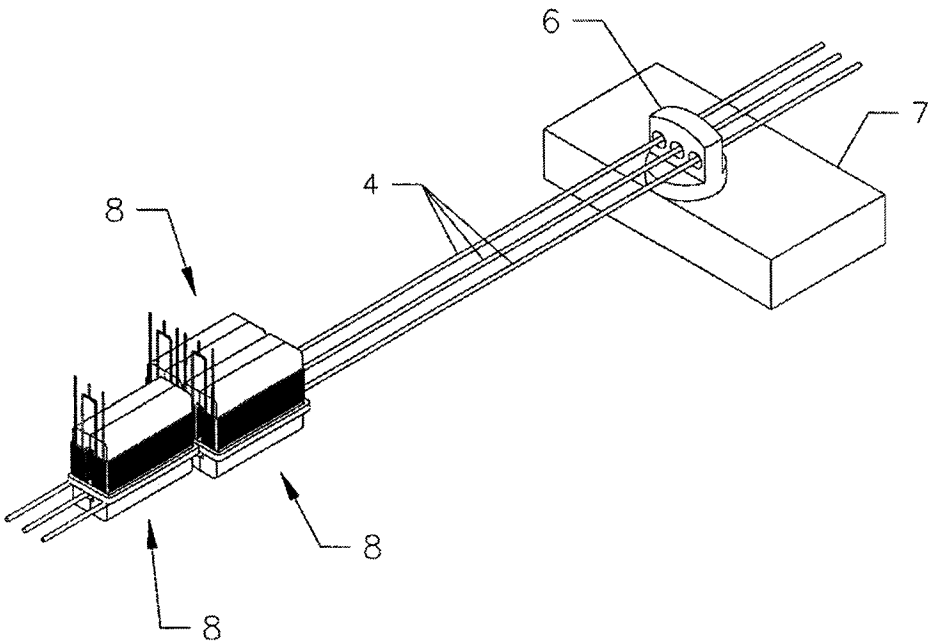
FIG. 2 illustrates the current pump attached to three piano strings according to an exemplary embodiment.

FIG. 2 illustrates a group of three piano strings 4, which make up a note in a piano, and these three piano strings 4 pass through an agraffe 6, which is permanently attached to the harp 7 of the piano. One current pump 8 is installed around each piano string 4, so there are three current pumps 8. Based on the size of the current pump 8, the current pumps 8 may need to be staggered to fit a current pump 8 around each piano string 4.

Figure 3:
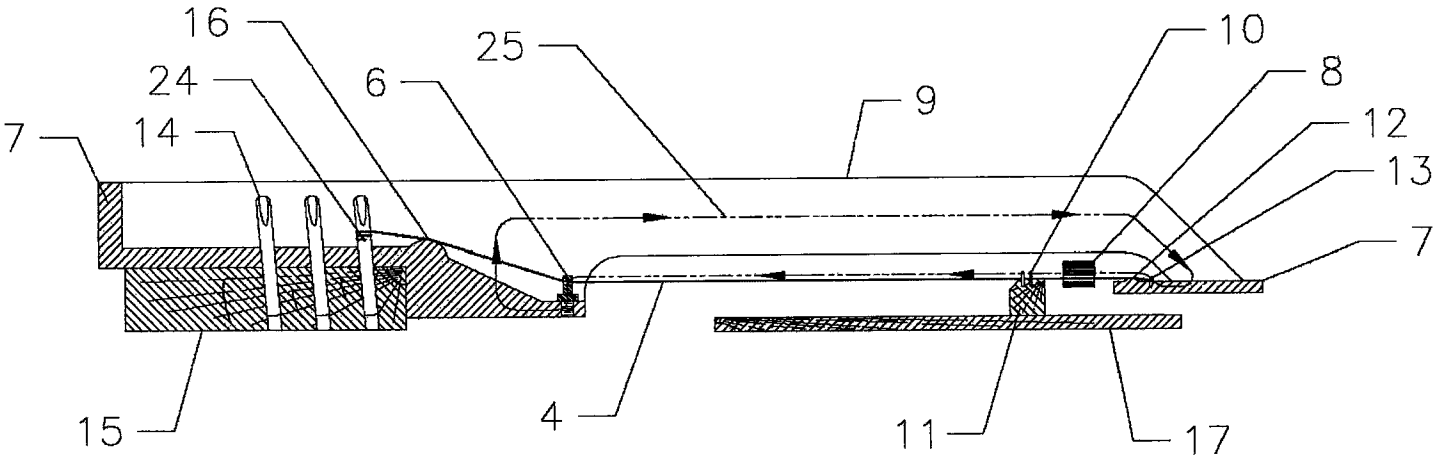
FIG. 3 illustrates a cross-section of a piano showing the closed electrical circuit formed by piano components according to an exemplary embodiment.

FIG. 3 illustrates a flow of current through components of a conventional piano. A first end of the piano string 4 is wound around a tuning pin 14, which is embedded in the piano's wooden pin block 15. The piano string 4 is anchored in a small hole 24 in the tuning pin 14. The piano string 4 extends over a metal string rest 16, through a metal agraffe 6, and, through the air, to a metal bridge pin 10, which is embedded in the wooden bridge 11 of the piano, which is, in turn, fastened to a wooden sound board 17. The piano string 4 further extends over another metal string rest 12, and the second end of the piano string 4 is anchored with a metal hitch pin 13 that is embedded in the metal harp 7. An electrically-conductive path 25 exists through the piano string 4, the agraffe 6, the metal harp 7, the harp 7 and crossbeam 9, and the metal hitch pin 13. The electrically-conductive path 25 comprises a closed electrical circuit that exists for each and every piano string 4 in the piano. The harp 7 and the crossbeams 9 serve as a common electrical return conductor for all the piano strings 4 in the piano. The current pump 8 may surround the piano string 4 at any point along the piano string 4 between the agraffe 6 and the hitch pin 13 and pump current in the electrically-conductive path 25. A preferred location where the current pump 8 may surround to the piano string 4 may be along the short segment of piano string 4 that is between the bridge pin 10 and the hitch pin 13, so that the current pump 8 does not interfere with the piano string's 4 musically-vibrating segment that is between the bridge pin 10 and agraffe 6.

Figure 4A:
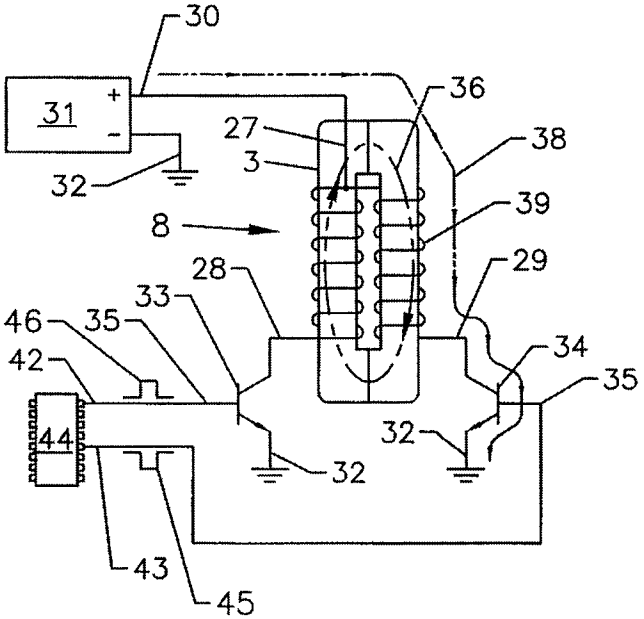
FIGS. 4(*a*) and 4(*b*) illustrate electrical diagrams of the current pump according to an exemplary embodiment.

FIG. 4(*a*) and FIG. 4(*b*) illustrate a preferred mechanism for creating the alternating magnetic flux in the current pump 8. In this circuit, the center tap terminal 27 of the current pump 8 is connected to the positive terminal 30 of a direct-current (DC) power supply 31. The DC power supply 31 may be any DC power supply, such as a battery. The beginning terminal 28 and end terminal 29 of the current pump 8 are each connected through transistors 33 and 34 to an electrical ground terminal 32 of the DC power supply 31, such as the negative terminal of a battery. While transistors 33, 34 have been and will be described as the electronic switching mechanism to alternatingly connect and disconnect a terminal to ground, other electronic switching mechanisms may replace the transistors 33, 34 such as mechanical switches, electromechanical nano-technology switches, or any other electronic component capable of high frequency connection and disconnection from a circuit. The transistors 33, 34 may be any power-type transistor including a bipolar junction transistor (BJT), a field effect transistor (FET), or a Darlington transistor. The transistors 33, 34 connect and disconnect the beginning and end terminals 28, 29 from electrical ground terminal 32, when a logical "high" 46 or "low" 45 signal is applied to the transistors' gate 35. The logical "high" signal 46 may be a positive 5-volt DC signal, and the logical "low" signal 45 may be a zero-volt, or ground, connection. By connecting end terminal 29 of the current pump 8 to electrical ground terminal 32 while disconnecting the beginning terminal 28 from electrical ground terminal 32 a first electrical current 38 flows through the winding 39 around the core 3 and a clockwise magnetic flux 36 is produced in the core 3. Conversely, by connecting the beginning terminal 28 of the current pump 8 to electrical ground terminal 32 while disconnecting the end terminal 29 from electrical ground terminal 32, a second electrical current 40 flows through the winding 41 of the opposite half of the core 3 and the direction of rotation of the current in the winding 41 is reversed. Thus a counter-clockwise magnetic flux 37 is produced in the core 3.

By alternating the two schemes illustrated in FIG. 4(*a*) and FIG. 4(*b*) at a high frequency, a high-frequency alternating magnetic flux is produced in the core 3 of the current pump 8. The frequency of this alternating magnetic flux is identical to the frequency at which the transistors 33 and 34 are continually alternated. This high-frequency signal to the transistors 33 and 34 is produced by the reversing output terminals 42 and 43 of a controller 44, e.g., microcontroller, controller, processor, computer, and so forth. A preferred controller 44, would utilize a microcontroller chip such as, but not limited to, one of the "ATTiny" series, manufactured by Atmel Corporation, having a place of business at 1600 Technology Drive, San Jose, Calif. 95110, but any microcontroller circuit capable of producing at least two output signals that can be switched in the 1-500 kHz frequency range could also be used.

Since the current pumps 8 must create a relatively large flow of magnetic flux to heat the piano strings 4, yet remain small enough to fit between the piano strings 4 of the piano, the current pumps 8 are wound with just a few turns of electrical wire 5. This short length of wire 5 has a very low resistance to electrical current and would quickly heat up and damage or destroy the current pump 8 if excited at a low-frequency.

An inductor coil of wire 5 exhibits an impedance to the flow of electrical current according to the following formula:

$$X_L = \omega L$$

where $X_L$ is the inductive reactance, or the impedance, in ohms (Ω), ω is the angular frequency of the alternating magnetic field in radians per second (rad/s), and L is the inductance of the coil in henrys (H).

The inductance L depends on the number of turns of wire and the core geometry and material. The inductance L remains constant for a given coil configuration. For any coil of given inductance L, it can be seen that its inductive reactance $X_L$ is proportional to the frequency ω applied. A higher frequency ω results in higher impedance.

The current flow of such a coil adheres to the following formula:

$$I = \frac{V}{X_L}$$

where V is the voltage applied to the coil in volts (V), and I is the current passing through the coil windings in amperes (A). This formula is analogous to Ohm's Law for a resistor and shows that the current is inversely proportional to the inductive reactance. Thus, more inductive reactance $X_L$ results in a lower winding current I.

To avoid excessive currents in the current pumps 8, the current pump 8 must be excited at a high-frequency such that the resulting inductive reactance of the current pump 8 is great enough to resist the flow of electricity and produce a large flow of magnetic flux while only passing a small amount of current.

Figure 5:
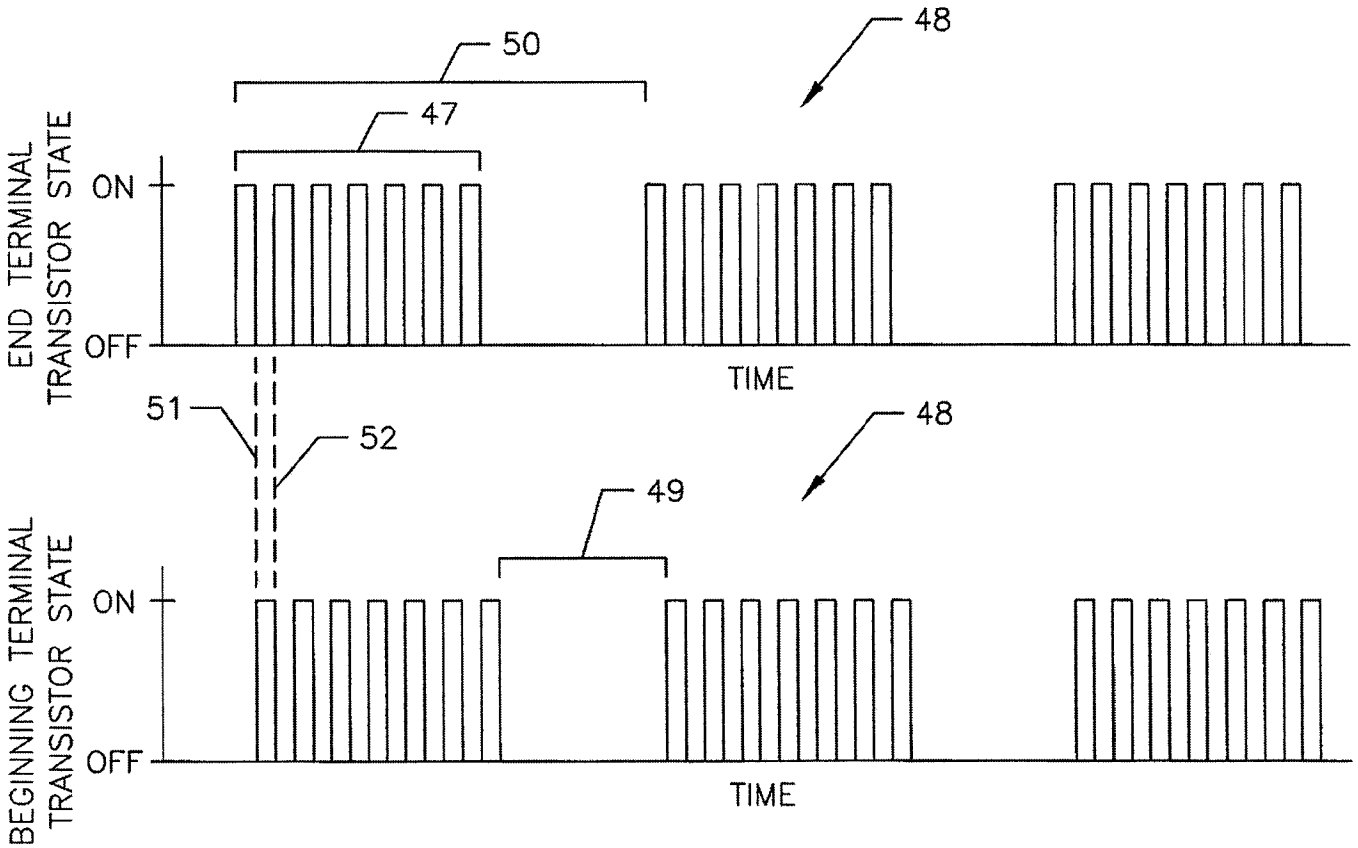
FIG. 5 illustrates a graph showing the high-frequency input signal to the current pump and a pulse-width modulated duty cycle for the current pump according to an exemplary embodiment.

FIG. 5 illustrates signals applied to the transistors 33, 34 previously shown in FIG. 4(*a*) and FIG. 4(*b*). The signals alternate to produce the high-frequency excitation signal 47. Each time the end terminal 29 is switched "off," or disconnected from electrical ground terminal 32, the beginning terminal 28 is switched "on" and connected to electrical ground terminal 32. An example of this instance is illustrated by the first dashed line 51. Conversely, each time the beginning terminal 28 is switched "off;" the end terminal 29 is switched "on," as illustrated by the second dashed line 52. By continuing this alternating scheme at a high frequency, the controller 44 produces the necessary high-frequency signal that results in a high-frequency alternating magnetic flux in the current pump 8, which induces a high-frequency alternating electrical current in the piano string 4. The necessary frequency of this signal depends on the inductive characteristics of the current pump 8 and is held constant throughout the operation of the present invention.

To control the temperature of the piano string 4, the high-frequency signal from the controller 44 is interrupted by a pulse-width modulation duty cycle. The high-frequency excitation signal 47 of the output signal 48 is produced by the controller 44. As long as the current pumps 8 receive this high-frequency excitation signal 47, current flows in the winding 41, alternating magnetic flux flows in the core 3 and alternating electrical current flows in the piano string 4 causing it to heat up and lower in pitch. This signal is interrupted regularly by inactive periods 49 where the controller 44 outputs switch both of the transistors "off" disconnecting both the beginning terminal 28 and the end terminal 29 from electrical ground terminal 32. During this period, no current passes through either winding 39 and 41, no alternating magnetic flux passes through the core, and no alternating electrical current is induced in the piano string 4, allowing it to cool. This interruption occurs on a regular schedule according to the duty cycle desired, which is expressed as a percentage of active time of the high-frequency excitation signal 47 of the total cycle time 50. The higher this duty-cycle percentage, the higher the percentage of time the alternating electrical current is active and the warmer the piano string 4 becomes. By controlling this percentage with the controller 44, the temperature and thus the pitch of the piano string 4 can be controlled as desired.

The current pumps 8 may be part of the self-tuning piano system disclosed in U.S. Pat. No. 6,559,369, which is herein incorporated by reference, in its entirety. The current pumps 8 may work in tandem with the magnetic pick-ups discussed in U.S. Pat. No. 6,559,369 to determine when the piano string 4 is in tune.

Because piano strings 4 vary in length and pitch, each piano string 4 has a unique current pump 8 associated with it to tune the piano string 4. As described above, some piano notes have up to three piano strings 4, which are struck in unison when the note is played by a pianist. Each piano string 4 comprising a note is associated with a unique current pump 8. To associate with a particular piano string 4, the current pumps 8 may vary in size, number of windings, and the frequency output of the controller 44, or pulse-width modulation duty cycle times. For example, each current pump 8 may have a differently configured controller 44. More specifically, a controller 44 associated with a first piano string 4 may have a different PWM duty cycle programming than a second piano string 4.

This alternating magnetic flux continuously circulates around the piano string 4 inducing an alternating electrical current (AC) in a continuous circuit through the piano string-harp loop previously described as if it were "pumping" the current. The alternating three-wire method that drives the device is similar in operation to a DC-to-AC power inverter as is commonly used, for example, to produce AC power from a direct-current (DC) source, such as an automobile battery. The resulting pumped current in this short-circuited loop is what heats the piano string 4 and affects its pitch.

Figure 6:
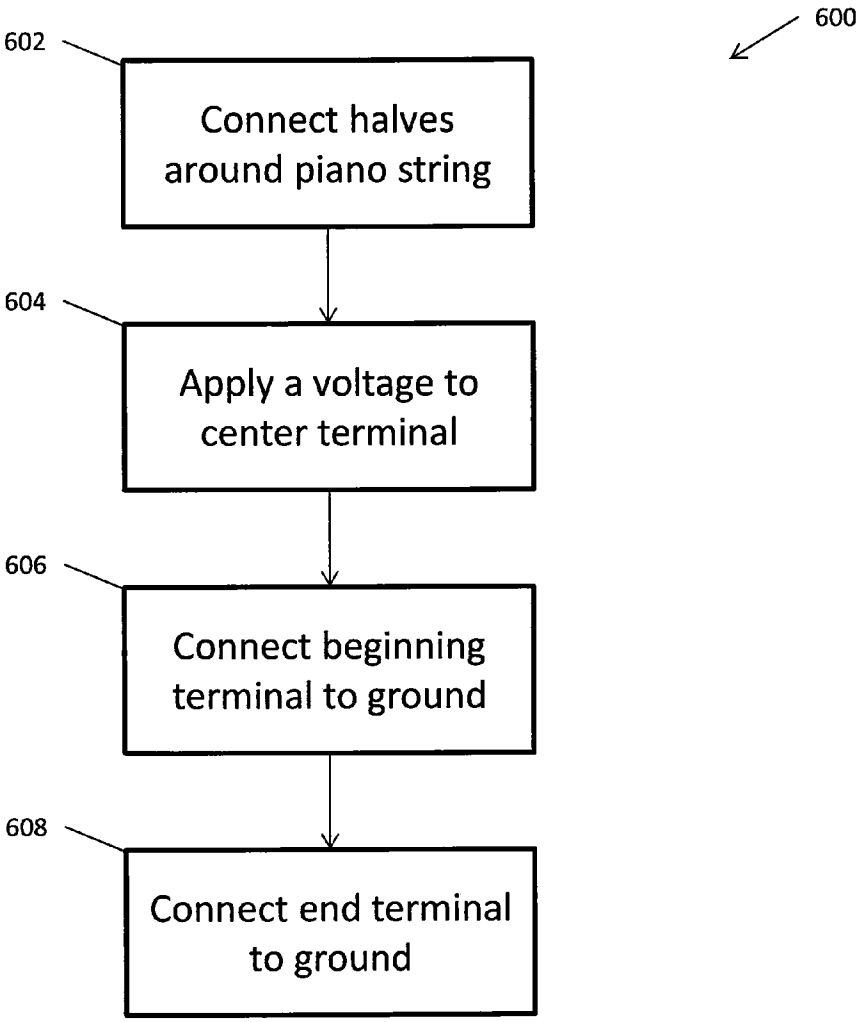
FIG. 6 illustrates a flow chart for the method of using the current pump according to an exemplary embodiment.

FIG. 6 illustrates a flowchart of a method for automatic tuning of a piano that is generally indicated by numeral 600. In the description of the flowchart, the functional explanation marked with numerals in angle brackets, <nnn>, will refer to the flowchart blocks bearing that number.

The method 600 begins in step <602> when two core halves or members 1, 2 of the current pump 8 are connected or installed around a piano string 4. As discussed above, each current pump 8 is piano string 4 specific, so the proper current pump 8 should be installed on the corresponding piano string 4. In addition, as described above, the current pump 8 may be installed by attaching a rubber band 26 around the two core halves 1, 2 or by any other connection means.

After the current pump 8 is in place, the current pump 8 may connect to a DC power supply 31, and the DC power supply 31 may apply a voltage to the center tap terminal 27 of the winding 41 in step <604>. The end terminal 29 and the beginning terminal 28 may connect to an electrical ground terminal 32 on the DC power supply 31.

Once connected, the controller 44 applies a logical high signal 46 to the gate 35 of the first transistor 33, thereby connecting the beginning terminal 28 to electrical ground terminal 32, and thereby generating a current through the winding 41 surrounding the first half core winding 1 in step <606>. While the controller 44 emits a logical high signal 46 to the first transistor 33, the controller 44 emits a logical low signal 45 to the second transistor 34 to disconnect the winding 41 around the second half core winding 2. According to a frequency schedule, the controller 44 will subsequently switch the signals to send a logical high signal 46 to the second transistor 34, thereby connecting the end terminal 29 to electrical ground terminal 32, and thereby generating a current through the winding 41 surrounding the second half core winding 2 in step <608>. While the controller 44 emits a logical high signal 46 to the second transistor 34, the controller 44 emits a logical low signal 45 to the first transistor 33 to disconnect the winding 41 around the first half core winding 1. After generating current in the piano string 4, the controller 44 may send a logical low signal 45 to both the first and second transistors 33, 34 according to a pulse-width modulation duty cycle to control the temperature in the piano string 4.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An apparatus for automatic tuning of a piano string comprising:

a core having at least one first side member and at least one second side member, wherein the at least one first side member and at least one second side member are separated by a piano string when positioned or the automatic tuning;

a wire winding wound around the two side members of the core, wherein the wire winding includes a first terminal, a second terminal, and a third terminal of the wire winding located between the first terminal and the second terminal and connected to a positive terminal of a DC power supply; and an electrical switching mechanism configured to alternatingly electrically connect either the first terminal or the second terminal to ground to thereby induce an alternating magnetic flux in the core, thereby inducing an alternating electrical current in the piano string for the purpose of changing temperature and pitch of the piano string.

2. The apparatus of claim 1, wherein the first terminal is a beginning terminal located at a first end of the wire winding, the second terminal is an end terminal located at a second end of the wire winding, and the third terminal is a center tap terminal located at the midsection of the wire winding.

3. The apparatus of claim 1, wherein the core encircles the piano string.

4. The apparatus of claim 3, wherein the core includes a first split core half and a second split core half.

5. The apparatus of claim 4, wherein the first split core half and the second split core half connect to each other with a fastener.

6. The apparatus of claim 2, wherein the wire winding is split at the center tap terminal, producing two sets of windings that are connected in series.

7. The apparatus of claim 2, wherein the electronic switching mechanism comprises:

a first transistor connected to the beginning terminal and ground;

a second transistor connected to the end terminal and ground; and a controller configured to send control signals to the gates or bases of the first and second transistors to selectively connect the beginning terminal or the end terminal to ground and disconnect the other terminal from ground.

8. The apparatus of claim 7, wherein the controller includes a microcontroller that alternates the signal activating either the first transistor or the second transistor at a rate of 1-500 kHz.

9. The apparatus of claim 7, wherein the controller includes a circuit that is configured to periodically interrupt the control signals based on a pulse-width-modulated duty cycle.

10. The apparatus of claim 9, wherein the pulse-width modulated duty cycle varies depending on which piano string in the piano is configured for tuning.

11. The apparatus of claim 1, wherein the core comprises a magnetically-permeable material.

12. The apparatus of claim 1, wherein the wire winding comprises an insulated wire.

13. The apparatus of claim 1, wherein the wire winding surrounds the piano string between a bridge pin and a hitch pin, wherein the bridge pin is connected to a bridge of a piano and the hitch pin is attached to a harp for the piano.

14. The apparatus of claim 1, wherein the number of windings around the at least one first side member is the same as the number of windings around the at least one second side member.

15. The apparatus of claim 1, wherein the number of windings in the wire winding varies depending on which piano string in the piano is configured for tuning.

16. An apparatus for automatic tuning of a piano string comprising:

a core having at least one first side member and at least one second side member, wherein at least one first side member and at least one second side member are separated by a piano string when positioned for the automatic tuning;

a wire winding wound around the two side members of the core, wherein the wire winding includes a first terminal, a second terminal, and a third terminal of the wire winding located between the first terminal and the second terminal and connected to ground; and an electrical switching mechanism configured to alternatingly electrically connect either the first terminal or the second terminal to a DC power supply to thereby induce an alternating magnetic flux in the core, thereby inducing an alternating electrical current in the piano string for the purpose of changing temperature and pitch of the piano string.

17. A method for inducing an alternating electrical current in a piano string to tune the piano string comprising:

installing a current pump around a piano string by placing two members of the current pump on opposite sides of the piano string, wherein a wire winding is wound around the two members of the current pump;

connecting a first terminal on a first end of the wire winding to ground while disconnecting a second terminal on a second end of the wire winding from ground;

subsequently connecting the second terminal to ground while disconnecting the first terminal from ground; and applying a voltage to a third terminal of the wire winding located between the first terminal and the second terminal.

18. The method of claim 17, further comprising periodically disconnecting both the first terminal and the second terminal from ground based on a pulse-width-modulated duty cycle.

19. The method of claim 18, wherein the pulse-width modulated duty cycle varies depending on which piano string in the piano is configured for tuning.

20. The method of claim 17, wherein connecting the first terminal to ground while disconnecting the second terminal from ground comprises:

generating, by a controller an activation control signal and a deactivation control signal;

transmitting, by the controller, the activation signal to the gate or base of a first transistor; and transmitting, by the controller, the deactivation signal to the gate or base of a second transistor.

21. The method of claim 20, wherein the controller alternates transmitting the activation signal to the first and second transistors at a rate of 1-500 kHz.

* * * * *